US006088838A

United States Patent [19]

Sontag

[11] Patent Number: 6,088,838

[45] Date of Patent: Jul. 18, 2000

[54] APPARATUS FOR HEAD, NECK AND/OR FACE PROTECTION

[76] Inventor: Richard L. Sontag, 16 School St., Rye, N.Y. 10580

[21] Appl. No.: 09/115,199

[22] Filed: Jul. 15, 1998

[51] Int. Cl.[7] ..... A42B 1/04

[52] U.S. Cl. ..... 2/202; 2/203

[58] Field of Search ..... 2/202, 203, 171, 2/410

[56] References Cited

U.S. PATENT DOCUMENTS

| | | | |
|---|---|---|---|
| 2,970,318 | 2/1961 | Nordling . | |
| 2,998,611 | 9/1961 | Schuessler . | |
| 3,157,887 | 11/1964 | Rothstein . | |
| 3,373,447 | 3/1968 | Kim . | |
| 3,531,952 | 10/1970 | Chesebro, Jr. . | |
| 4,573,217 | 3/1986 | Reed . | |
| 4,641,380 | 2/1987 | Epstein . | |
| 5,007,115 | 4/1991 | Denbow et al. . | |
| 5,035,006 | 7/1991 | Hetz et al. . | |
| 5,109,548 | 5/1992 | Balaban et al. . | |
| 5,109,549 | 5/1992 | Mattinson | 2/202 |
| 5,309,574 | 5/1994 | Balaban et al. . | |
| 5,765,230 | 6/1998 | Sivret et al. | 2/202 |
| 5,875,493 | 3/1999 | MacDonald et al. | 2/172 |
| 5,881,389 | 3/1999 | Fruge | 2/202 |

*Primary Examiner*—Diana Oleksa

*Attorney, Agent, or Firm*—Ostrolenk, Faber, Gerb & Soffen, LLP

[57] ABSTRACT

An adjustable hood including a hood portion having a face opening and a rear portion disposed substantially opposite to the face opening, the face opening including a first edge portion and a second edge portion, the first edge portion having first and second spaced apart ends. The adjustable hood also includes a neck portion which is receivable in the hood portion and a cord disposed at the first edge portion of the face opening, the cord being extendable (i) away from the first edge portion of the respective first and second ends, and (ii) towards the rear portion of the hood. The adjustable hood also includes a plurality of clamp elements operable to move along the cord and fixedly engage the cord such that the cord draws the first edge portion of the face opening towards the face of the user when it is extended from and engaged by a pair of the clamp elements at the first and second ends.

33 Claims, 4 Drawing Sheets

APPARATUS FOR HEAD, NECK AND/OR FACE PROTECTION

BACKGROUND OF THE INVENTION

1. Field of the Invention

The present invention relates to an adjustable hood and, more particularly, to an adjustable hood having a cord which is capable of providing engagement between a face opening and a user's face as well as providing a snug fit at the rear of the hood.

2. Related Art

Head coverings having hood portions and neck portions are known. U.S. Pat. Nos. 2,998,611 and 3,157,887 disclose a head cover equipped with a cuff that may be adjusted to protect the ears of a wearer or, when desired, adjusted above the ears. At the same time, the head covering provides a face hood which may be drawn downwardly to protect the face of the wearer, where the face hood is adapted to be telescoped within the cap when the face hood is not in use.

U.S. Pat. No. 3,531,952 discloses a knit head cover including a crown portion, a face portion having an elongated face opening, a constricted neck engaging portion, and a lower dickey portion having front and rear panels.

It is also known to provide head and neck garments with a drawstring. U.S. Pat. No. 5,077,115 discloses a loose fitting head and neck garment including a drawstring which allows adjustment in the circumference of an end which provides a means for securing the garment in a chosen wearing position.

Unfortunately, the head coverings of the prior art do not provide a means for engaging a face opening of the head covering with the face of a user and providing an adjustable snug fit at the sides and rear of the head cover with the user's head.

SUMMARY OF THE INVENTION

In order to overcome the deficiencies in the prior art, the present invention provides an adjustable hood including a hood portion having a face opening and a rear portion disposed substantially opposite to the face opening, the face opening including a first edge portion and a second edge portion, the first edge portion having first and second spaced apart ends. The adjustable hood also includes a neck portion which is receivable in the hood portion and a cord disposed at the first edge portion of the face opening, the cord being extendable (i) away from the first edge portion of the respective first and second ends, and (ii) towards the rear portion of the hood. The adjustable hood also includes a plurality of clamp elements operable to move along the cord and fixedly engage the cord such that the cord draws the first edge portion of the face opening towards the face of the user when it is extended from an engaged eye a pair of the clamp elements at the first and second ends.

BRIEF DESCRIPTION OF THE DRAWINGS

For the purpose of illustrating the invention, there are shown in the drawing forms which are presently preferred, it being understood, however, that the invention is not limited to the precise arrangements and instrumentalities shown.

DETAILED DESCRIPTION OF THE PREFERRED EMBODIMENTS

Figure 1:
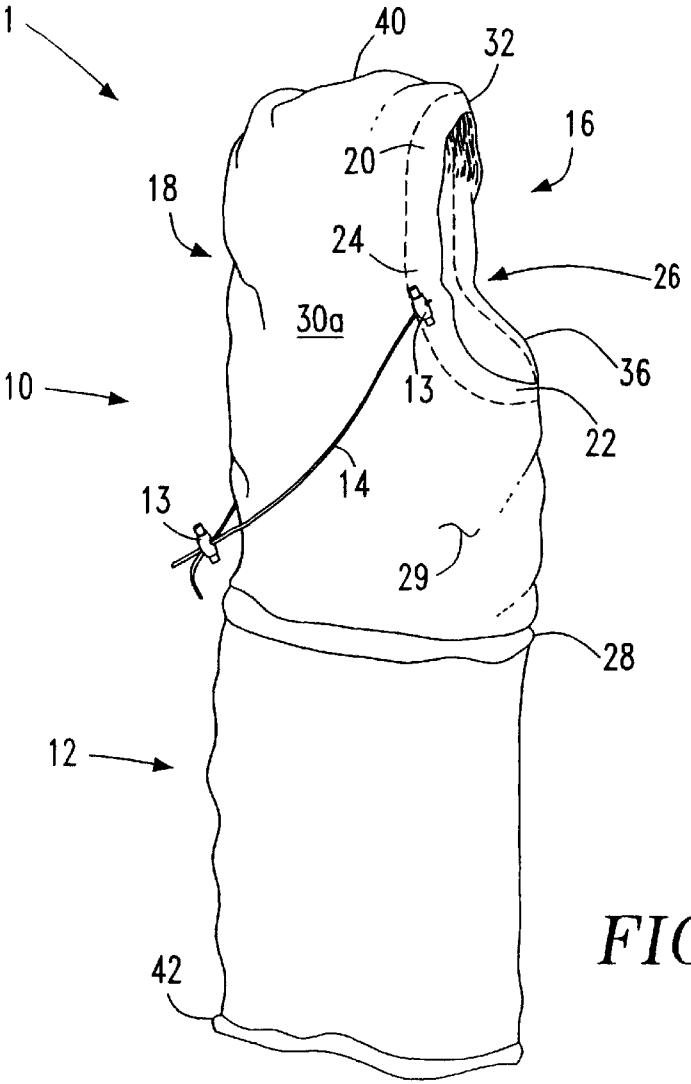
FIG. 1 is a side perspective view of the adjustable hood of the present invention with a neck portion of the adjustable hood extended below a hood portion.

Referring now to the drawings wherein like numerals indicate like elements, there is shown in FIG. 1 an adjustable hood 1 having a hood portion 10, a neck portion 12, a cord 14, and a plurality of clamp elements 13.

The hood portion 10 includes a face opening 16 and a rear portion 18 disposed substantially opposite to, and spaced away from, the face opening 16. The face opening 16 includes an upper edge portion 20 and a lower edge portion 22 which are disposed at the periphery of the face opening 16. The first edge portion 20 includes first and second spaced apart ends 24, 26 which are preferably disposed proximate to side portions 30*a*, 30*b*, respectively, of the hood portion 10 (side portion 30*b* is disposed substantially opposite to side portion 30*a* but cannot be seen in the figures).

The hood portion 10 also includes a lower peripheral edge 28 from which the neck portion 12 extends. It is preferred that the hood portion 10 include a rain resistant sheath 29 which covers at least a portion of the hood 10. Therefore, it is preferred that the lower peripheral edge 28 be a lower edge of the rain resistant sheath 29.

Figure 2:
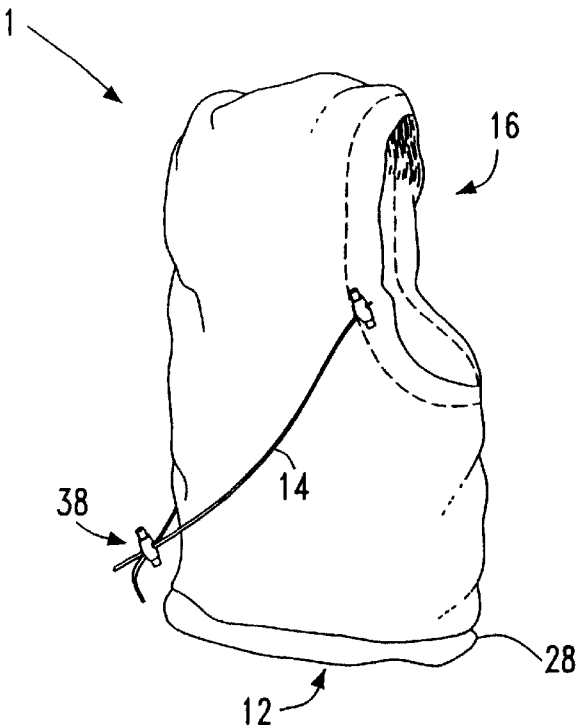
FIG. 2 is a side perspective view of the adjustable hood of FIG. 1 with the neck portion received within the hood portion.

As best seen in FIG. 2, the neck portion 12 is receivable within the hood portion 10, preferably in a cuffed or telescoped orientation, such that the neck portion 12 provides double insulation within the hood portion 10. Preferably, the hood portion 10 and the neck portion 12 are integrally formed from one piece of material. It is most preferred that the hood portion 10 and the neck portion 12 be formed from a fleece material, for example, any of the known natural or synthetic fleece materials which are available.

Figure 3:
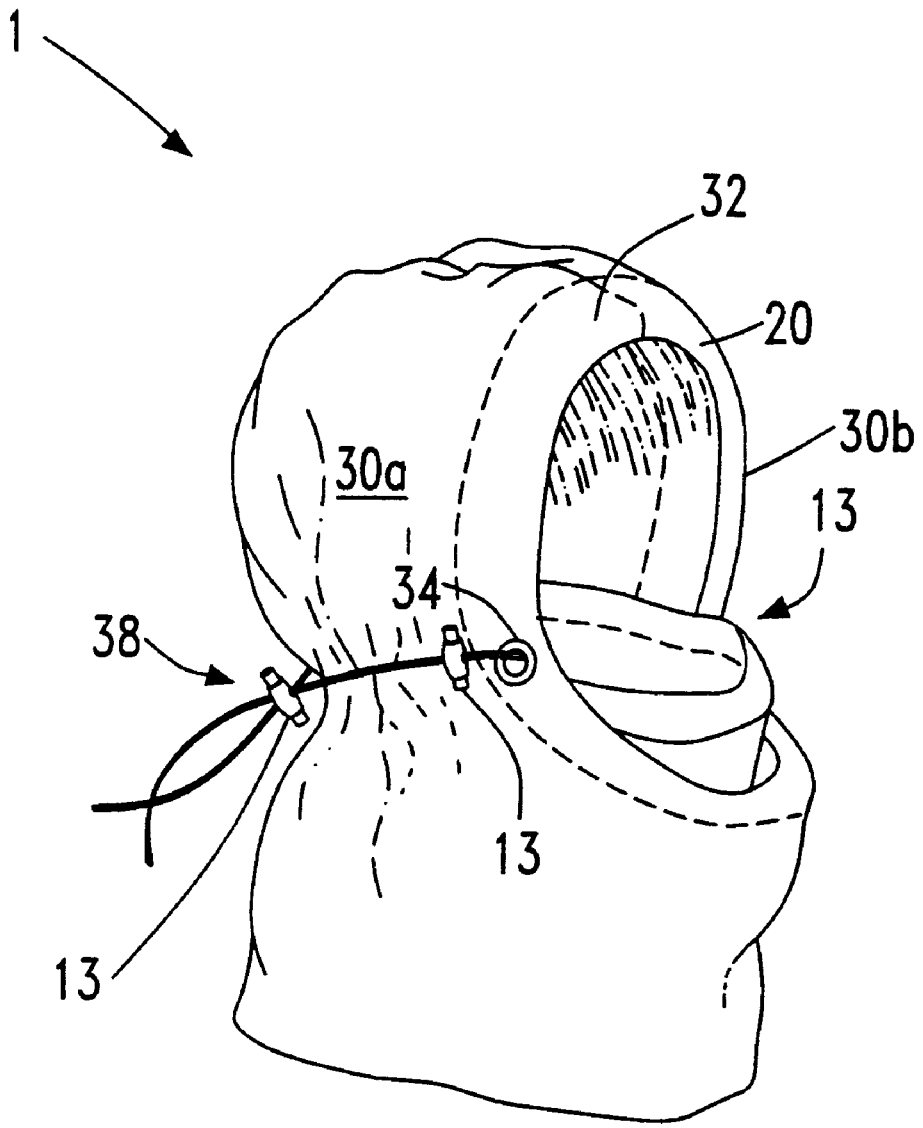
FIG. 3 is a side perspective view of the adjustable hood of FIGS. 1 and 2 with the neck portion extending up past a lower edge portion of a face opening of the hood.

The upper edge portion 20 includes a channel 32 which extends along the periphery of the upper edge portion 20 and terminates at the first and second ends 24, 26. As best seen in FIG. 3, the first and second ends 24, 26 preferably include eyelets 34, where the cord 14 extends through the channel 32 and exits the channel through the first and second ends 24, 26 via the eyelets 34.

Referring again to FIG. 1, the lower edge portion 22 of the face opening 16 preferably includes elastic 36 located at the periphery of the lower edge portion 22, which elastic 36 is operable to draw the lower edge portion 22 towards the face of a user. When the cord 14 is drawn through the channel 32 and out the first and second end portions 24, 26, the upper edge portion 20 of the face opening 16 is drawn towards the face of the user, thereby providing a snug fit.

As best seen in FIG. 3, the clamp elements 13 are adjustable along the cord 14 and prevent the cord 14 from re-entering the channel 32 once the cord 14 has been drawn through the eyelets 34. Thus, the upper edge portion 20 remains in a snug orientation with the face of the user. The clamp elements 13 are preferably formed from spring loaded barrels which are known to be manually manipulated to move along a cord and fixedly engage the cord where desired.

The cord 14 is operable to extend around the side portions 30*a*, 30*b* of the hood portion 10 and adjust at the rear portion 18 of the hood portion 10 via one or more of the clamping elements 13 (preferably barrels) such that the cord 14 draws the rear portion 18 of the hood 10 towards the head of the user to provide a snug (or cinched) fit. It is noted that when the cord 14 is drawn through the channel 32 and towards the rear portion 18 of the hood portion 10, it simultaneously causes the upper edge portion 20 to snugly engage the forehead of the user and the rear portion 18 to snugly engage the back of the user's head. Consequently, the adjustable hood 1 of the present invention provides improved protection of the user's head and neck from the elements.

Figure 4:
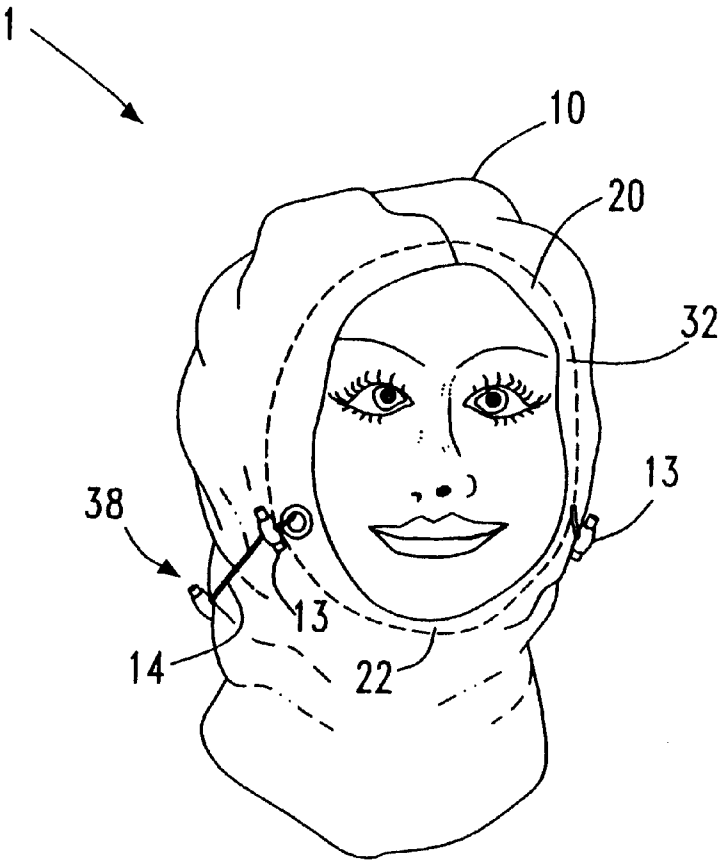
FIG. 4 is a front perspective view of an adjustable hood in accordance with the present invention shown in use, where a neck portion of the hood is received within a hood portion.

FIG. 4 shows the adjustable hood 1 of the present invention in use where the cord 14 has been drawn through the channel 32 and engaged by the clamp elements 13 such that the upper edge portion 20 of the face opening 16 snugly engages the forehead of the user and a rear portion 18 of the hood 10 is drawn against the rear of the user's head.

Figure 5:
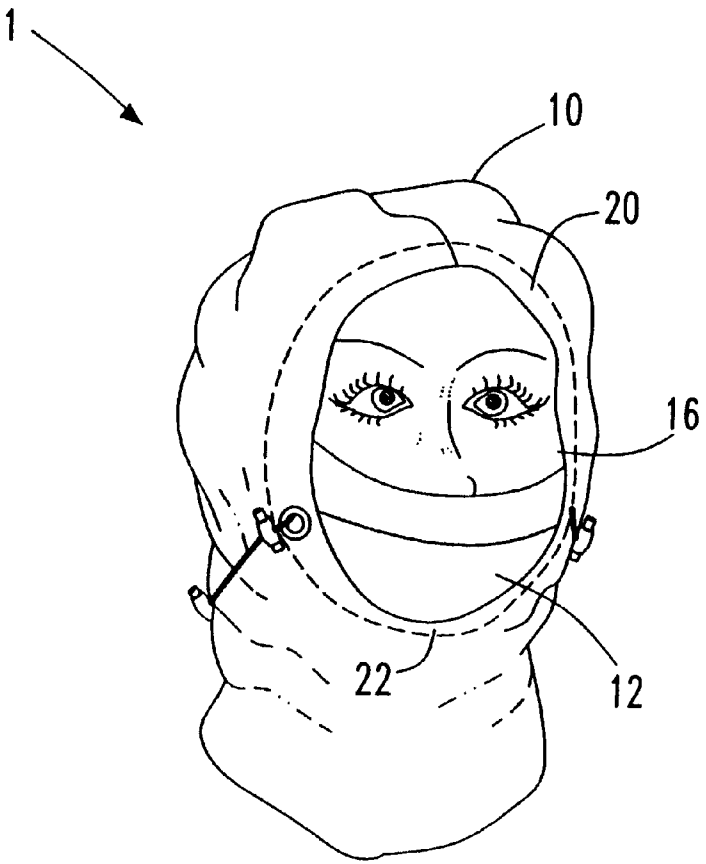
FIG. 5 is a front perspective view of the adjustable hood of FIG. 4 where the neck portion extends up past a lower edge portion of the face opening such that at least a portion of the user's face is protected from the elements.

FIG. 5 shows the neck portion 12 telescoped within the hood portion 10 and extending upwards past the lower edge portion 22 of the face opening 16 such that at least part of the face opening 16 is blocked by the neck portion 12 to provide additional protection of the user's face, for example, the nose, mouth and chin area of the user.

Figure 7:
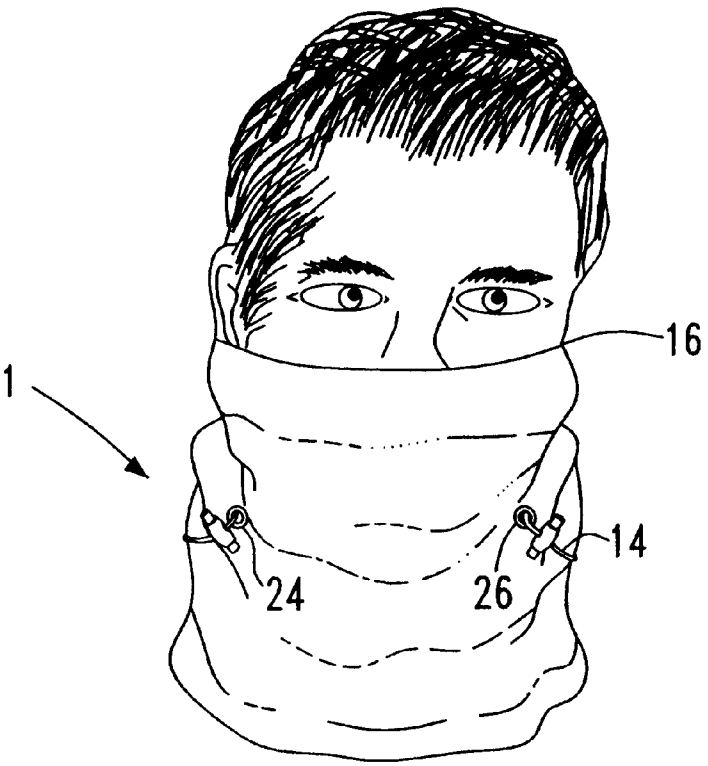
FIG. 7 shows the adjustable hood of FIG. 6 in a position providing both face and neck protection.
Figure 6:
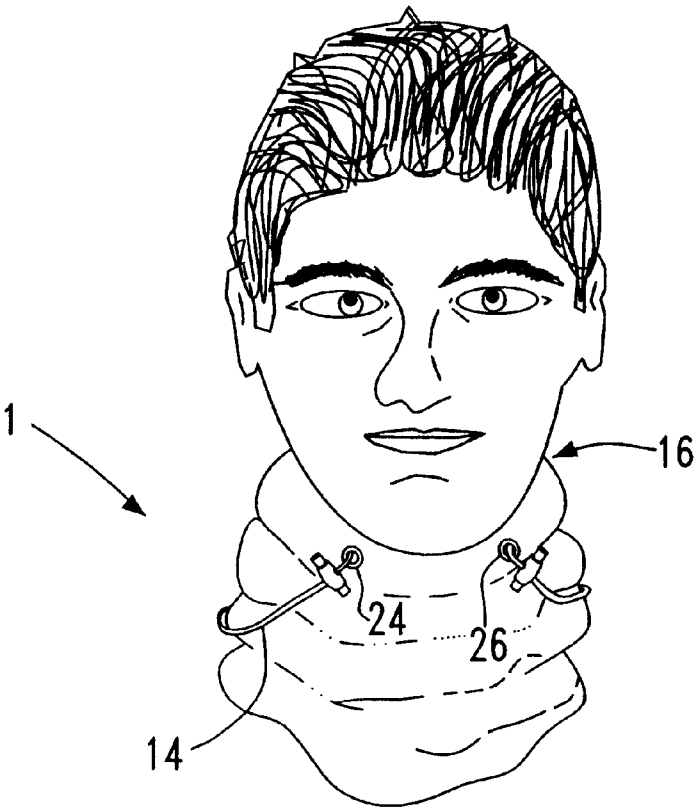
FIG. 6 is a front view of an adjustable hood in accordance with the invention where the hood is used exclusively for neck protection.

Reference is now made to FIGS. 6 and 7 which show the adjustable hood 1 of the present invention configured to protect only the neck of the user (FIG. 6) or both the neck and a portion of the face of the user (FIG. 7). To achieve these functions, the face opening 16 is sized such that the user's head may at least partially extend through the face opening 16. As will be apparent to those skilled in the art from the above teaching, the cord 14 may be drawn through the channel 32 (not shown) to provide a snug fit when in use to protect the user's neck and/or face.

It has been found that satisfactory operation of the adjustable hood 1 is obtained when certain dimensional characteristics are obtained. For example, it is preferred that a first distance, defined from a top portion 40 of the hood 10 (FIG. 1) to the lower peripheral edge 28 of the hood 10 is substantially the same as a second distance, defined from the lower peripheral edge 28 to the end 42 of the neck portion 12. It is preferred that the first distance is approximately 1.2 feet long and the second distance is approximately 1 foot long.

The foregoing description of the preferred embodiments of the present invention have been provided for the purposes of illustration and description. They are not intended to be exhaustive or to limit the invention to the precise forms disclosed. Many modifications and variations are possible in light of the above teaching. It is intended that the scope of the invention not be limited by this detailed description.

What is claimed is:

1. An adjustable hood, comprising:

a hood portion having a face opening and a rear portion disposed substantially opposite from the face opening, the face opening including a first edge portion and a second edge portion, the first edge portion having first and second spaced apart ends;

elastic disposed at the second edge portion of the face opening operable to draw the second edge portion towards the face of the user;

a neck portion connected to the hood portion and being receivable in the hood portion or being extendable away from the hood portion;

a cord disposed at the first edge portion of the face opening, the cord being extendable: (i) away from the first edge portion at the respective first and second ends, and (ii) towards the rear portion of the hood; and a plurality of clamp elements being operable to move along the cord and fixedly engage the cord, the cord drawing the first edge portion of the face opening toward the face of a user when it is extended and engaged by the clamp elements at the first and second ends.

2. The adjustable hood of claim 1, wherein the cord is extended around the hood and is adjustably coupled at the rear portion of the hood by one or more of the clamp elements, the cord bringing the rear portion of the hood toward the head of the user to provide a snug fit.

3. The adjustable hood of claim 2, wherein the cord brings oppositely positioned side portions of the hood toward the user's head to provide the snug fit.

4. The adjustable hood of claim 1, wherein the first and second ends are disposed at substantially oppositely spaced apart side portions of the hood.

5. The adjustable hood of claim 4, wherein the first edge portion includes a channel terminating at the first and second ends, the first and second ends having eyelets, the cord extending through the channel and exiting the channel through the eyelets.

6. The adjustable hood of claim 1, wherein the clamp elements are spring loaded barrels.

7. The adjustable hood of claim 1, wherein the first edge portion is disposed at an upper peripheral edge of the face opening operable to engage the user's forehead, and the second edge portion is disposed at a lower peripheral edge of the face opening.

8. The adjustable hood of claim 1, wherein the face opening is sized such that the user's head may at least partially extend therethrough, the cord being operable to draw the first edge portion of the face opening toward the user's head to provide a snug fit.

9. The adjustable hood of claim 8, wherein the face opening is capable of being positioned at the users head such that a lower portion but not an upper portion of the user's head is covered, the hood and neck portions extending downward away from the face opening.

10. The adjustable hood of claim 8, wherein the face opening, the hood portion and the neck portion are capable of being positioned at the users neck such that the neck but not the user's head is covered.

11. The adjustable hood of claim 1, further including a rain resistant sheath covering at least a portion of the hood portion.

12. The adjustable hood of claim 1, wherein at least one of the hood and neck portions is formed from a fleece material.

13. The adjustable hood of claim 1, wherein the hood portion includes a lower peripheral edge, the neck portion extending from the lower peripheral edge and receivable within the hood in a cuffed fashion to provide double insulation.

14. The adjustable hood of claim 13, wherein the first edge portion is disposed at an upper peripheral edge of the face opening operable to engage the user's forehead, and the second edge portion is disposed at a lower peripheral edge of the face opening, the neck portion being extendable upwards past the lower peripheral edge of the face opening to at least partially cover the face opening and provide protection of at least a portion of the user's face.

15. The adjustable hood of claim 13, wherein a first distance is defined from a top portion of the hood to the lower peripheral edge of the hood and a second distance is defined from the lower peripheral edge of the hood to an end of the neck portion, the first and second distances being substantially the same.

16. The adjustable hood of claim 13, wherein a first distance is defined from a top portion of the hood to the lower peripheral edge of the hood and a second distance is defined from the lower peripheral edge of the hood to an end of the neck portion, the first distance being about 1.2 feet long and the second distance being about 1.0 feet long.

17. The adjustable hood of claim 1, wherein the hood portion and the neck portion are integrally formed from one piece of material.

18. An adjustable hood, comprising:

a hood portion having a face opening and a rear portion disposed substantially opposite from the face opening, the face opening including a first edge portion and a second edge portion, the first edge portion having first and second spaced apart ends;

a neck portion connected to the hood portion and being receivable in the hood portion or being extendable away from the hood portion;

a cord disposed at the first edge portion of the face opening, the cord being extendable: (i) away from the first edge portion at the respective first and second ends, and (ii) towards the rear portion of the hood; and a plurality of clamp elements being operable to move along the cord and fixedly engage the cord, the cord drawing the first edge portion of the face opening toward the face of a user when it is extended from and engaged by the clamp elements at the first and second ends, the cord extending around the hood and being adjustably coupled at the rear portion of the hood by one or more of the clamp elements, the cord bringing the rear portion of the hood toward the head of the user to provide a snug fit.

19. The adjustable hood of claim 18, wherein the cord brings oppositely positioned side portions of the hood toward the user's head to provide the snug fit.

20. The adjustable hood of claim 18, wherein the first and second ends are disposed at substantially oppositely spaced apart side portions of the hood.

21. The adjustable hood of claim 18, wherein the first edge portion includes a channel terminating at the first and second ends, the first and second ends having eyelets, the cord extending through the channel and exiting the channel through the eyelets.

22. The adjustable hood of claim 18, wherein the clamp elements are spring loaded barrels.

23. The adjustable hood of claim 18, wherein the first edge portion is disposed at an upper peripheral edge of the face opening operable to engage the user's forehead, and the second edge portion is disposed at a lower peripheral edge of the face opening.

24. The adjustable hood of claim 18, wherein the face opening is sized such that the user's head may at least partially extend therethrough, the cord being operable to draw the first edge portion of the face opening toward the user's head to provide a snug fit.

25. The adjustable hood of claim 24, wherein the face opening is capable of being positioned at the users head such that a lower portion but not an upper portion of the user's head is covered, the hood and neck portions extending downward away from the face opening.

26. The adjustable hood of claim 24, wherein the face opening, the hood portion and the neck portion are capable of being positioned at the users neck such that the neck but not the user's head is covered.

27. The adjustable hood of claim 18, further including a rain resistant sheath covering at least a portion of the hood portion.

28. The adjustable hood of claim 18, wherein at least one of the hood and neck portions is formed from a fleece material.

29. The adjustable hood of claim 18, wherein the hood portion includes a lower peripheral edge, the neck portion extending from the lower peripheral edge and receivable within the hood in a cuffed fashion to provide double insulation.

30. The adjustable hood of claim 29, wherein the first edge portion is disposed at an upper peripheral edge of the face opening operable to engage the user's forehead, and the second edge portion is disposed at a lower peripheral edge of the face opening, the neck portion being extendable upwards past the lower edge portion to at least partially cover the face opening and provide protection of at least a portion of the user's face.

31. The adjustable hood of claim 29, wherein a first distance is defined from a top portion of the hood to the lower peripheral edge of the hood and a second distance is defined from the lower peripheral edge of the hood to an end of the neck portion, the first and second distances being substantially the same.

32. The adjustable hood of claim 29, wherein a first distance is defined from a top portion of the hood to the lower peripheral edge of the hood and a second distance is defined from the lower peripheral edge of the hood to an end of the neck portion, the first distance being about 1.2 feet long and the second distance being about 1.0 feet long.

33. The adjustable hood of claim 18, wherein the hood portion and the neck portion are integrally formed from one piece of material.

* * * * *